United States Patent [19]

Oswald et al.

[11] Patent Number: 5,060,939

[45] Date of Patent: Oct. 29, 1991

[54] MULTI-POSITION EXERCISE BENCH

[75] Inventors: Clifford J. Oswald, Lexington, Ky.; John C. Ostertag, Auburn, Ala.

[73] Assignee: Diversified Products Corporation, Opelika, Ala.

[21] Appl. No.: 677,449

[22] Filed: Mar. 29, 1991

Related U.S. Application Data

[63] Continuation of Ser. No. 590,926, Oct. 1, 1990.

[51] Int. Cl.[5] ..... A63B 21/00

[52] U.S. Cl. ..... 272/144; 272/117; 272/123

[58] Field of Search ..... 272/117, 118, 123, 134, 272/144, 145, DIG. 4

[56] References Cited

U.S. PATENT DOCUMENTS

| | | | |
|---|---|---|---|
| 4,509,746 | 4/1985 | Mask | 272/117 |
| 4,575,077 | 3/1986 | Osborne et al. | 272/123 X |
| 4,629,185 | 12/1986 | Amann | 272/134 X |
| 4,749,190 | 6/1988 | Jenninon | 272/144 |
| 4,765,616 | 8/1988 | Wolfe | 272/144 |
| 4,928,957 | 5/1990 | Lanier et al. | 272/134 X |
| 4,934,695 | 6/1990 | Wolff | 272/134 |

*Primary Examiner*—Robert Bahr

*Attorney, Agent, or Firm*—Banner, Birch, McKie & Beckett

[57] ABSTRACT

A multi-position exercise bench convertible between a chair-like configuration for supporting a user in a seated position with back support, and a bench-like configuration for supporting the user in a reclining position. Three pivotally interconnected bench portions can be configured with the front and center bench portions substantially coplanar and the rear bench portion forming a back support, or with the rear and center bench portions substantially coplanar and in a reclined position.

9 Claims, 3 Drawing Sheets

MULTI-POSITION EXERCISE BENCH

This application is a continuation of application Ser. No. 07/590,926, filed Oct. 1, 1990, pending.

BACKGROUND OF THE INVENTION

This invention relates to exercise equipment and, in particular, to versatile exercise benchs that are adjustable to various configurations to accommodate various exercises.

Convertible exercise benches of various types are known in the prior art. Among these are benches which are convertible between a chair-like configuration for supporting a user in a seated position with a back support, and a bench-like configuration for supporting the user in a reclining position. These types of devices typically employ fairly complicated linkages and are difficult to reconfigure, often requiring the removal and repositioning of multiple pins which lock the various bench components in desired positions. These complex constructions and the complexity of use associated with them make these prior art bench construction somewhat difficult and time consuming to use. A need therefore exists for a multi-position exercise bench which is much simpler to use than prior art structures.

SUMMARY OF THE INVENTION

It is ,therefore, an object of the invention to provide a multi-position exercise bench convertible between a chair-like configuration for supporting a user in a seated position with back support, and a bench-like configuration for supporting the user in a reclining position which is simpler in construction and much easier to reconfigure than prior art benches.

Another object of the invention is to provide such a multi-position exercise bench which does not rely on conventional pins to fix the various bench components in desired positions.

Another object of the invention is to provide such a multi-position exercise bench whose configuration can be readily changed through simple manipulation of the bench components while standing adjacent the bench.

These and other objects of the invention are accomplished by providing a multi-position exercise bench convertible between a chair-like configuration for supporting a user in a seated position with back support, and a bench-like configuration for supporting the user in a reclining position, comprising a frame; a front bench portion pivoted to a front portion of the frame, and having an upper user supporting surface; a rear bench portion pivoted to a rear portion of the frame, and having the user supporting surface that functions as a back support when in a chair-like configuration; and a center bench portion intermediate the front and rear bench portions, and having an upper user supporting surface. Front coupling means pivotally interconnects the front and center bench portions and fix those portions in a substantially coplanar relationship when in the chair-like configuration to form a seat. Rear coupling means pivotally interconnects the rear and center bench portions and fixes those portions in a substantially coplanar relationship when in the bench-like configuration to form an extended reclined support.

BRIEF DESCRIPTION OF THE DRAWINGS

The novel features of the invention are set out with particularity in the appended claims, but the invention will be understood more fully and clearly from the following detailed description of the invention as set forth in the accompanying drawings, in which:

DETAILED DESCRIPTION OF THE INVENTION

The following description of a preferred embodiment of the invention relates to a multi-position exercise bench of the type described above which is adapted to be secured to a weightlifting machine, including a loaded cable that can be operatively coupled to a leg exercise device, attached to the bench frame, for performing either leg lift exercises or leg curl exercises, as described below.

Figure 1:
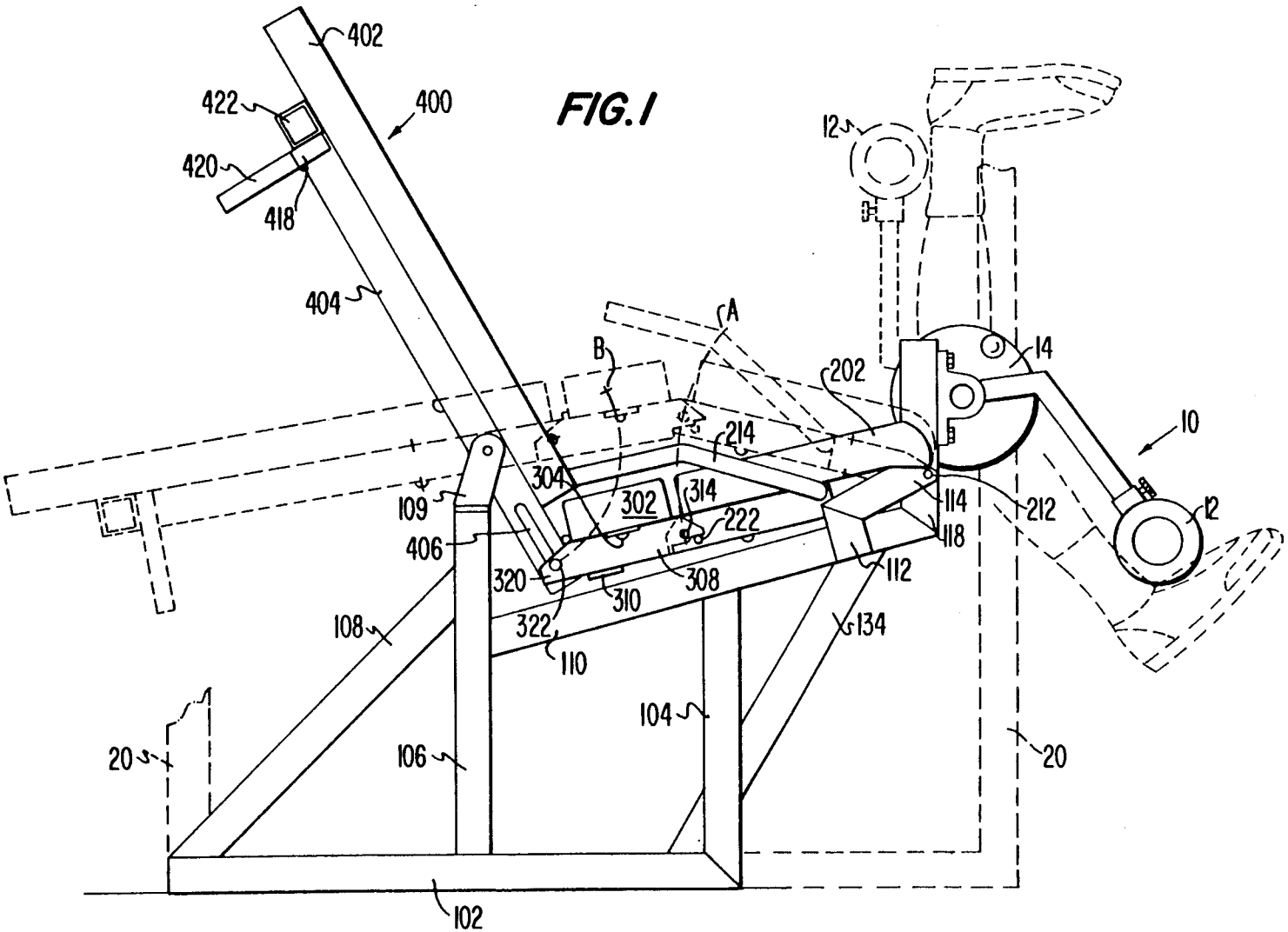
FIG. 1 is a side elevational view of the multi-position exercise bench according to the invention, showing the chair-like configuration in solid lines and the bench-like configuration in dashed lines.
Figure 2:
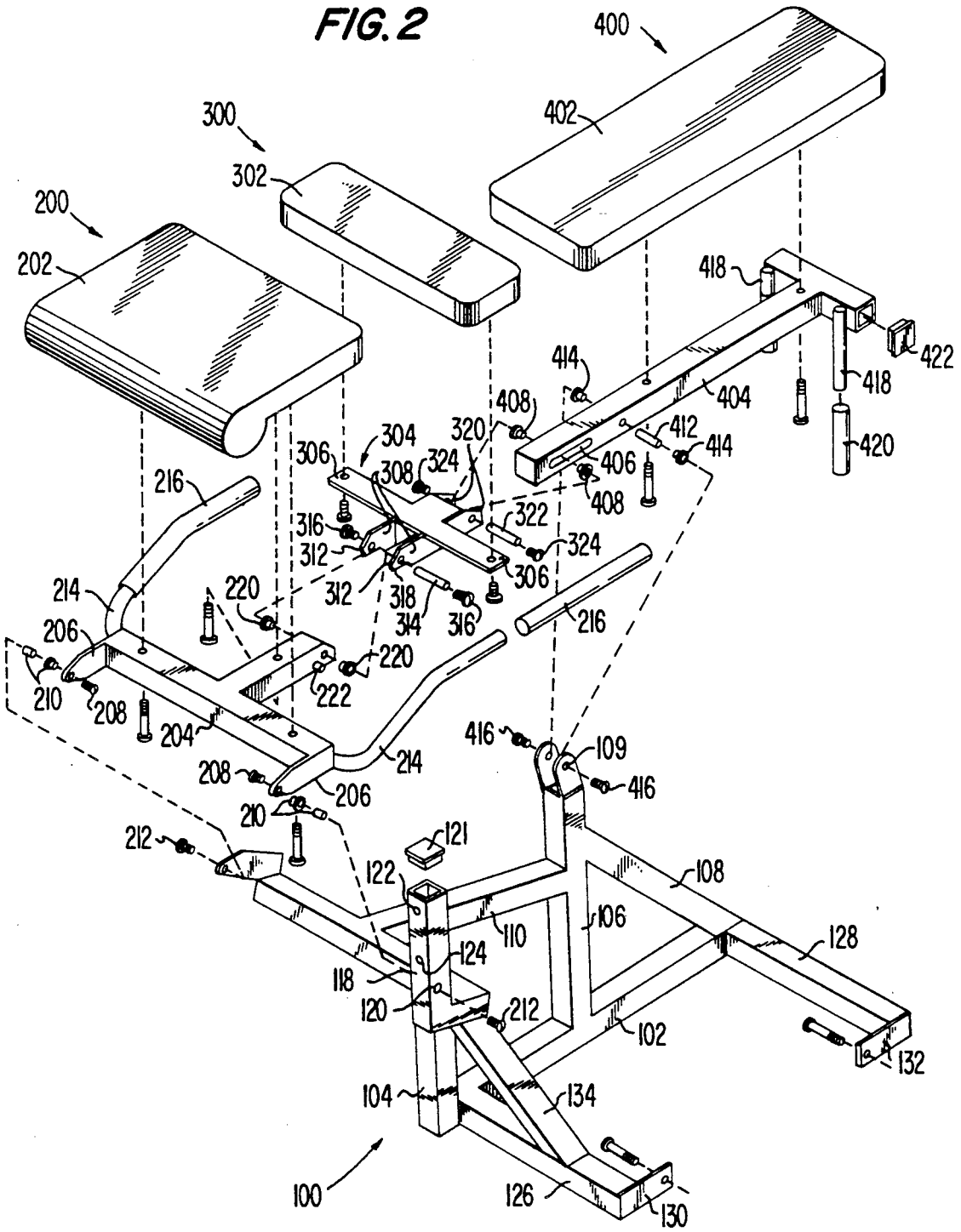
FIG. 2 is an exploded, perspective view of the exercise bench of FIG. 1.

Referring to FIGS. 1 and 2, and the exercise bench according to the invention comprises a welded steel frame 100 having a central longitudinal base member 102 which supports front and rear posts 104, 106, respectively, and an oblique rear brace 108. A clevis 109 is welded atop post 106. A central beam 110 is welded to posts 104, 106 and is forwardly cantilevered beyond post 104, terminating in a laterally extending front support beam 112. Welded to one end of beam 112 is a plate 114 having an aperture 116 therethrough. At the opposite end of beam 112 is a forwardly and upwardly extending accessory post 118 having an aperture 120 transversely aligned with aperture 116 in plate 114. A plastic plug 121 closes the open upper end of post 118. A known type of leglift device 10 (FIG. 1), having a cushioned ankle-engaging bar 12 adjustable in starting position by means of an apertured plate 14, is adapted to be bolted to post 118 through a pair of longitudinal holes 122, 124. Front and rear lateral base members 126, 128, have apertured flanges 130, 132, respectively, adapted to bolt the exercise bench to an adjacent piece of weightlifting equipment 20 (FIG. 1) which presents a loaded cable adapted to be secured to the leglift device 10. An oblique brace 134 is welded between base member 126 and beam 112.

A front bench portion 200 comprises a front seat cushion 202 bolted to a T-shaped front undercarriage 204 which is pivoted to plate 114 and post 118 by means of welded end plates 206, pivotally secured by means of bolts 208, bushings 210 and nuts 212. A pair of handles 214 having foam grips 216 are welded to undercarriage 204 and are pivotable therewith. Handles 214 extend alongside front seat cushion 202. At the rear of undercarriage 204 are aligned transverse holes 218 adapted to receive bushings 220. Lateral studs 222 project from each side of front undercarriage 204 just ahead of and below holes 218.

A center bench portion 300 comprises a center seat cushion 302 that is bolted to a center undercarriage 304. Undercarriage 304 is a winged socket-like member comprising a lateral top plate 306, parallel side plates 308 and a bottom plate 310. Side plates 308 have anterior apertured flanges 312 that embrace the rear of front undercarriage 204 and are pinned thereto by means of a pin 314 extending through holes 218 and secured by headed fasteners 316. The noses 318 of anterior flanges 312 abut studs 222 to limit downward pivotal movement of the front and center bench portions and maintain them in substantially coplanar relationship when the exercise bench is in its chair-like configuration. At the rear of center undercarriage 304 is a pair of posterior apertured side flanges 320 which are extensions of side plates 308, that support a pin 322 secured in place by headend fasteners 324.

Rear bench portion 400 comprises a back support or cushion 402 that is bolted to a T-shaped rear undercarriage 404 having at its front end a horizontal slot 406. Bushings 408 are retained on pin 322 and ride in slot 406 as undercarriage 404, received and guided in the socket-like undercarriage 304, slides forwardly or rearwardly therewithin, as described below. Rear undercarriage 404 is pivotally attached to clevis 109 through aligned apertures 410, a pin 412, bushings 414 and headend fasteners 416. Depending rear handles 418, having foam handgrips 420, are welded to rear undercarriage 404. Plastic plugs 422 close the open lateral ends of undercarriage 404.

Figure 4:
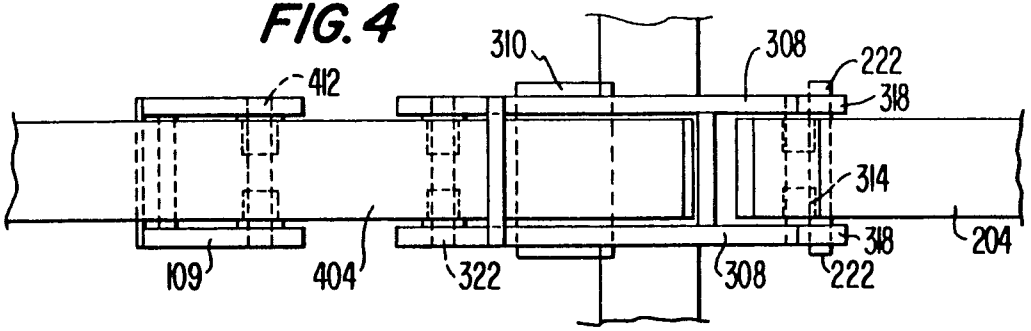
FIG. 4 is a top plan of the upper configuration shown in FIG. 3.
Figure 3:
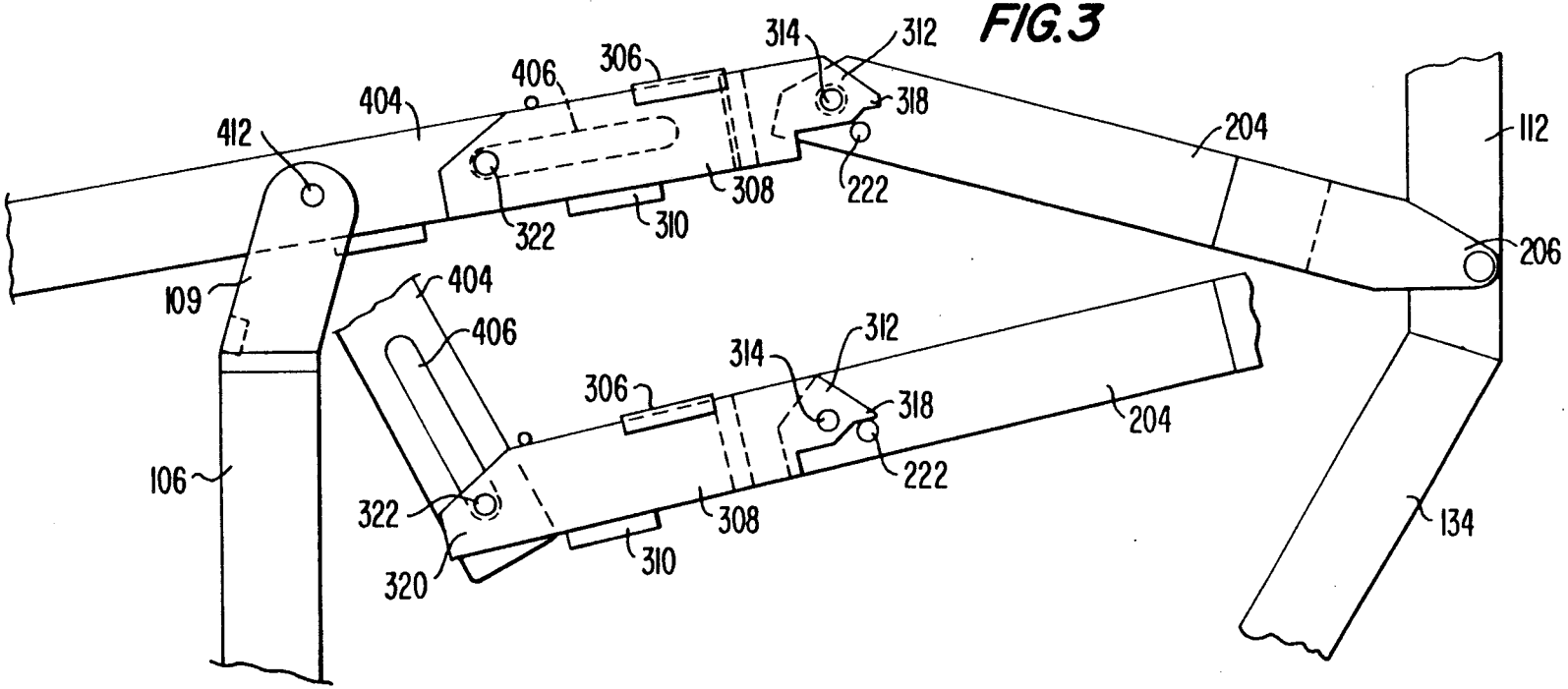
FIG. 3 is a side elevation view of a portion of the exercise bench of FIGS. 1 and 2, with portions not illustrated for the sake of clarity, shown in two alternate configurations.

Referring to FIGS. 1, 3 and 4, frame 100, front undercarriage 204, center undercarriage 304 and rear undercarriage 404 together form a four-bar linkage which is movable between the chair-like configuration shown in solid lines in FIG. 1, and a number of alternate positions upon lifting of handles 214 to rotate front undercarriage 204 upwardly. The slotted and pinned arrangement 322, 406, in conjunction with the mating socket-like configuration of undercarriages 304 and 404, provided added stability to the system when in the bench-like configuration illustrated in dashed lines in FIG. 1. As there illustrated, and as shown in the upper configuration of FIG. 3 and in FIG. 4, the rear undercarriage 404 has been slid forwardly between flanges 308 and plates 304, 310 to secure rear bench portion 400 and center bench portion 300 in substantially coplanar relationship and at an angle to front bench portion 200 that is greater than 180°, with each bench portion declining from the horizontal. Rear undercarriage 404 is able to slide within the socket-like undercarriage 304 by virtue of the ability of the undercarriage components to rotate above the dashed line positions shown in FIG. 1. Specifically, before rear undercarriage 404 begins to slide within center undercarriage 304, pin 314 rises to the position designated by point A in FIG. 1, while pin 322, at the forward end of slot 406, rises to the position illustrated by point B in FIG. 1. Thereupon, as rear bench portion 400 is pushed forwardly, undercarriage 404 slides within undercarriage 304 and the bench portions rotate downwardly to the dashed line position illustrated in FIG. 1. Reversal of this process frees the rear and center bench portions from one another and allows the assembly to be rotated back to the chair-like configure shown in FIG. 1.

It is apparent from the above description that the multi-position exercise bench according to the invention accomplishes the stated objectives of providing a simple and easy-to-reconfigure multifunction exercise apparatus. It will be obvious to one of ordinary skill in the art that numerous modifications may be made without departing from the true scope of the invention, which is to be limited only by the appended claims. For example, the exercise bench can assume bench-like configurations intermediate those illustrated in FIG. 1 by providing several spaced notches along one side of slot 406 into which pin 322 can be seated, thus limiting the extent of telescoping engagement of rear undercarriage 404 and socket-like undercarriage 304. In one of these configurations the bench would be completely flat, i.e., all bench portions would be substantially coplanar. No matter what the bench-like configuration, however, rear bench portion 400 and center bench portion 300 would be coplanar.

We claim:

1. A multi-position exercise bench convertible between a chair-like configuration for supporting a user in a seated position with back support, and a bench-like configuration for supporting the user in a reclining position, comprising:

a frame;

a front bench portion pivoted to a front portion of said frame, and having an upper user-supporting surface;

a rear bench portion pivoted to a rear portion of said frame, and having a user-supporting surface that functions as a back support when in a chair-like configuration;

a center bench portion intermediate said front and rear bench portions, and having an upper user-supporting surface;

front coupling means pivotally interconnecting said front and center bench portions and fixing said front and center bench portions in a substantially coplanar relationship when in the chair-like configuration to form a seat; and rear coupling means pivotally interconnecting said rear and center bench portions and fixing said rear and center bench portions in a substantially coplanar relationship when in the bench-like configuration to form an extended reclined support.

2. An exercise bench according to claim 1 wherein said front coupling means comprises a pivoted connection between said front and center bench portions, and stop means limiting downward pivotal movement of said front and center bench portions to a substantially coplanar relationship.

3. An exercise bench according to claim 2 wherein said rear coupling means comprises a horizontal slot and pin connection between said rear and center bench portions, and guide means for maintaining said rear center bench portions substantially coplanar as said pin moves along said slot.

4. An exercise bench according to claim 3 wherein said guide means comprises a socket beneath the user-supporting surface of said center bench portion, said socket having posterior parallel side flanges with said pin extending transversely between said flanges, and a rear undercarriage post beneath the user-supporting surface of said rear bench portion adapted to mate with said socket, said slot formed in the front end of said rear post and embracing said pin.

5. An exercise bench according to claim 1 wherein when said exercise bench is in a bench-like configuration, the supporting surfaces of said substantially coplanar rear and center bench portions and the supporting surface of said front bench portion form an included angle that is greater than 180 degrees, with each of said supporting surfaces declining from the horizontal.

6. An exercise bench according to claim 5 further comprising a front handle at each side of said front bench portion, attached thereto and pivotable therewith for grasping during exercise and for manipulating to change the configuration of the exercise bench.

7. An exercise bench according to claim 6 further comprising a pair of depending rear handles attached to said rear bench portion near the rear end and beneath the supporting surface thereof for grasping during exercise.

8. An exercise bench according to claim 1 further comprising accessory bracket means near the front of said frame for mounting a pivotable leg exercise device adapted to facilitate leg lift exercises with the user seated on the exercise bench in a chair-like configuration, and to facilitate leg curl exercises with the user lying prone on the exercise bench in a bench-like configuration.

9. An exercise bench according to claim 8 adapted to be secured to a weightlifting machine including a loaded cable adapted to be operatively coupled to the leg exercise device, further comprising mounting bracket means for attaching the exercise bench to the weightlifting machine.

* * * * *